US008986024B2

(12) United States Patent
Ikeda et al.

(10) Patent No.: US 8,986,024 B2
(45) Date of Patent: Mar. 24, 2015

(54) POWER SUPPLY CIRCUIT DISCONNECTION DEVICE

(71) Applicant: Yazaki Corporation, Tokyo (JP)

(72) Inventors: Tomohiro Ikeda, Shizuoka (JP); Fumitoshi Henmi, Shizuoka (JP); Yuichi Motoshige, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 50 days.

(21) Appl. No.: 13/889,784

(22) Filed: May 8, 2013

(65) Prior Publication Data

US 2013/0237078 A1 Sep. 12, 2013

Related U.S. Application Data

(63) Continuation of application No. PCT/JP2011/070839, filed on Sep. 13, 2011.

(30) Foreign Application Priority Data

Nov. 9, 2010 (JP) ..... 2010-251101
Feb. 21, 2011 (JP) ..... 2011-034397

(51) Int. Cl.
*H01H 3/04* (2006.01)
*H01H 9/10* (2006.01)
(Continued)

(52) U.S. Cl.
CPC ..... *H01R 13/629* (2013.01); *H01R 13/62955* (2013.01); *H01H 9/167* (2013.01); *H01R 13/62938* (2013.01); *H01H 31/122* (2013.01); *H01H 9/102* (2013.01)
USPC ..... 439/157; 200/335; 200/332; 439/188

(58) Field of Classification Search
USPC ..... 200/51.02–51.04, 51.07, 51.09, 51.12, 200/322, 43.02, 43.11, 335, 332; 439/157, 439/188, 372
See application file for complete search history.

(56) References Cited

U.S. PATENT DOCUMENTS 5,330,363 A * 7/1994 Gardner et al. ..... 439/188
6,361,356 B1 3/2002 Heberlein et al.
(Continued)

FOREIGN PATENT DOCUMENTS

CN 101226833 A 7/2008
CN 101242053 A 8/2008
(Continued)

OTHER PUBLICATIONS

European Search Report dated Apr. 7, 2014 from counterpart European Application No. 11 826 101.5.
(Continued)

*Primary Examiner* — Gary Paumen
(74) *Attorney, Agent, or Firm* — Finnegan, Henderson, Farabow, Garrett & Dunner, L.L.P.

(57) ABSTRACT

A power supply circuit disconnection device includes: a first connector housing (10); a second connector housing (20); a lever (30); a main circuit switch (SW1) that is switched off at a first operation position of the lever, and is switched on at a connector fitting operation position and second operation position of the lever; a signal circuit switch (SW2) that is switched off at the first operation position and connector fitting operation position of the lever; a first lock portion (LK1) that locks the lever at the second operation position; a second lock portion (LK2) that locks the lever at the connector fitting operation position; and a lock release operation portion capable of releasing, by an operation thereof, a lock state of the second lock portion.

7 Claims, 16 Drawing Sheets

(51) Int. Cl.

| | |
|---|---|
| *H01R 13/629* | (2006.01) |
| *H01H 9/16* | (2006.01) |
| *H01H 31/12* | (2006.01) |

(56) References Cited

U.S. PATENT DOCUMENTS

| | | | | |
|---|---|---|---|---|
| 6,619,970 | B2 | 9/2003 | Fukushima et al. | |
| 6,705,881 | B2 * | 3/2004 | Tsuchiya | 439/157 |
| 6,755,673 | B2 * | 6/2004 | Fukushima et al. | 439/157 |
| 6,982,393 | B2 * | 1/2006 | Matsui et al. | 200/335 |
| 7,284,997 | B2 * | 10/2007 | Joist | 439/157 |
| 7,625,225 | B2 * | 12/2009 | Mori et al. | 439/157 |
| 2003/0057958 | A1 | 3/2003 | Fukushima et al. | |
| 2005/0098419 | A1 | 5/2005 | Matsui et al. | |
| 2008/0185276 | A1 * | 8/2008 | Matsunaga et al. | 200/335 |
| 2009/0117764 | A1 * | 5/2009 | Mori et al. | 439/157 |

FOREIGN PATENT DOCUMENTS

| | | | |
|---|---|---|---|
| EP | 1 947 744 | A2 | 7/2008 |
| JP | 2003-100382 | | 4/2003 |
| JP | 2005-142107 | | 6/2005 |
| JP | 2008-176969 | | 7/2008 |
| KR | 10-2009-0052722 | A | 5/2009 |

OTHER PUBLICATIONS

International Search Report from Japanese Patent Office of PCT International Application No. PCT/JP2011/070839, mailed Nov. 8, 2011.

Office Action dated Mar. 27, 2014 in the counterpart Chinese Application No. 201180003969.9.

* cited by examiner (a)

(b)

POWER SUPPLY CIRCUIT DISCONNECTION DEVICE

CROSS-REFERENCE TO RELATED APPLICATION

This is a Continuation of PCT Application No. PCT/JP2011/070839, filed on Sep. 13, 2011, and claims the priority of Japanese Patent Applications No. 2010-251101, filed on Nov. 9, 2010 and No. 2011-034397, filed on Feb. 21, 2011, the contents of these applications are incorporated herein by reference.

TECHNICAL FIELD

The present invention relates to a power supply circuit disconnection device that performs connection/disconnection of a power supply circuit by fitting/separation of connector housings, either of which is added with a lever.

BACKGROUND ART

On an electric vehicle or a hybrid vehicle, a power supply circuit disconnection device (service plug) capable of disconnecting electrification between a power supply unit and a load is mounted for the purpose of ensuring operation safety in maintenance of an electrical system thereof. As this type of conventional power supply circuit disconnection device, there is one disclosed in Japanese Patent Laid-Open Publication No. 2003-100382 (Patent Literature 1).

As shown in FIG. 1 to FIG. 3, this power supply circuit disconnection device 100 includes: a first connector housing 101; a second connector housing 110 that is fitted to and separated from the first connector housing 101; and a lever 120 that is rotatably and slidably provided on the second connector housing 110, and applies, by rotation thereof, fitting force and separation force between the second connector housing 110 and the first connector housing 101.

On both side surfaces of the first connector housing 101, a pair of cam pins 102 are protruded. In the first connector housing 101, a one-side main terminal (not shown) and a one-side signal terminal (not shown) are individually provided. The one-side main terminal (not shown) is arranged in a connector fitting chamber. The one-side signal terminal (not shown) is arranged in an external hood portion 104.

On both side surfaces of the second connector housing 110, a pair of support shafts 111 are protruded. In the second connector housing 110, an other-side main terminal (not shown) is provided.

On both side surfaces of the lever 120, a pair of support shaft receiving grooves 121 are formed. Each of the support shaft receiving grooves 121 is composed of: a rotation support portion 121*a* that supports rotation of the support shaft 111; and a slide support portion 121*b* that communicates therewith, and supports sliding movement of the support shaft 111. In such a way, the lever 120 is supported on the second connector housing 110 so as to be freely rotatable and slidable. On both side surfaces of the lever 120, a pair of cam grooves 122 are provided. Each of the cam grooves 122 is composed of: a curve portion 122*a* that gradually changes a distance thereof from the rotation support portion 121*a*; and a straight portion 122*b* that communicates therewith, and is extended in parallel to the slide support portion 121*b*. The cam pins 102 of the first connector housing 101 are inserted into the pair of cam grooves 122. On a side portion of the lever 120, a connector 104 in which an other-side signal terminal (not shown) is housed is arranged. The other-side signal terminal (not shown) is arranged in the hood portion 124.

A main circuit switch (not shown) is composed of both of the main terminals (not shown). A signal circuit switch (not shown) is composed of both of the signal terminals (not shown).

In the above-described configuration, a description is made of a power supply conductive operation of the power supply circuit disconnection device 100. As shown in FIG. 1, the second connector housing 110 in which the lever 120 is set at a first operation position is inserted into the connector fitting chamber (not shown) of the first connector housing 101, and in addition, the cam pins 102 are inserted into inlets of the cam grooves 122 of the lever 120. Both of the connector housings 101 and 110 turn to a temporarily fitted state of a connector.

The lever 120 is rotated from the first operation position to a second operation position. Then, the cam pins 102 move in the cam grooves 122, the fitting force is applied between the second connector housing 110 and the first connector housing 101, and the second connector housing 110 is gradually inserted into the connector fitting chamber of the first connector housing 101.

As shown in FIG. 2, when the lever 120 is rotated to a fitting operation position of the connector, the first connector housing 101 and the second connector housing 110 turn to a completely fitted state. Both of the main terminals (not shown) gradually contact each other in the course to such a connector fitting operation position, and turn to a contact state at the connector fitting operation position. In such a way, the main circuit switch (not shown) turns to an ON state at the connector fitting operation position.

Next, the lever 120 is slidingly moved from the connector fitting operation position to the second operation position. In the course of this sliding movement, both of the signal terminals (not shown) gradually contact each other, and as shown in FIG. 3, turn to a contact state at the second operation position. In such a way, the signal circuit switch SW2 is in the ON state at an operation completion position of the lever 120.

Moreover, a power supply disconnection operation of the power supply circuit disconnection device 100 is performed by operating the lever 120 reversely to the above. That is to say, the lever 120 at the second operation position is slidingly moved to the connector fitting operation position, and is rotationally moved from the connector fitting operation position to the first operation position.

The power supply circuit disconnection device 100 does not turn a power supply circuit (not shown) to a conductive state until both of the main circuit switch (not shown) and the signal circuit switch SW2 are switched on. That is to say, only in the case where the lever 120 is at the second operation position, the power supply circuit turns to the conductive state, and in the case where the lever 120 is at other operation positions, the power supply circuit is in a non-conductive state.

In such a way, a situation is prevented, which is caused by a mistake that an operator determines the power supply circuit to be in the non-conductive state since the lever 120 is not at the second operation position.

Moreover, with regard to the lever 120, a slide operation thereof is performed from the second operation position to the connector fitting operation position, and a rotation operation thereof is performed from the connector fitting operation position to the first operation position. Therefore, there can be ensured a time lag in the operation of the lever 120 from the second operation position to the first operation position, that is, a time lag from when the signal circuit switch (not shown) is switched off to when the main circuit switch (not shown) is switched off. Accordingly, there does not occur a malfunction such as sparks resulting from an amount of electricity remaining after the signal circuit switch (not shown) is switched off.

CITATION LIST

Patent Literature

Patent Literature 1: Japanese Patent Laid-Open Publication No. 2003-100382

SUMMARY OF INVENTION

Technical Problem

However, in the above-described conventional power supply circuit disconnection device 100, the lever 120 is not only rotated but also slidingly moved, and accordingly, an operation space is increased by the amount of a sliding range S. Moreover, there is a problem that a structure of the power supply circuit disconnection device 100, which includes a metal die, becomes complicated.

In this connection, the present invention has been made in order to solve such problems as described above. It is an object of the present invention to provide a power supply circuit disconnection device that is capable of achieving reduction of the operation space and simplification of the structure including the metal die, and capable of preventing the malfunction resulting from the amount of electricity remaining after the signal circuit switch is switched off.

Solution to Problem

A first aspect of the present invention provides a power supply circuit disconnection device including: a first connector housing; a second connector housing fitted to and separated from the first connector housing; a lever that is rotatably provided on the second connector housing, applies fitting force and separation force between the second connector housing and the first connector housing by rotation thereof between a first operation position and a connector fitting operation position, and rotates from the connector fitting operation position to a second operation position; a main circuit switch that has main terminals provided individually on the first connector housing and the second connector housing, is turned to an OFF state at the first operation position of the lever, and is turned to an ON state at the connector fitting operation position and second operation position of the lever; a signal circuit switch that has signal terminals provided individually on the first connector housing and the lever, is turned to an OFF state at the first operation position and connector fitting operation position of the lever, and is turned to an ON state at the second operation position of the lever; a first lock portion that locks the lever at the second operation position; a second lock portion that locks the lever at the connector fitting operation position; and a lock release operation portion capable of releasing, by an operation thereof, a lock state of the second lock portion.

Preferably, the power supply circuit disconnection device further includes: a lock release inhibiting portion that inhibits movement of the second lock portion to a lock release position at the second operation position of the lever, and allows the movement of the second lock portion to the lock release position at the connector fitting position of the lever.

Preferably, the lever is configured to apply the fitting force and the separation force between the second connector housing and the first connector housing by the rotation thereof between the first operation position and the connector fitting operation position, and not to apply the fitting force and the separation force between the second connector housing and the first connector housing by rotation thereof between the connector fitting operation position and the second operation position.

Preferably, the first lock portion is capable of releasing lock thereof by rotation force applied to the lever by an operator, and the second lock portion is capable of releasing lock thereof by pressing force of the operator.

Preferably, both of the first lock portion and the second lock portion are capable of releasing lock thereof by pressing force of an operator.

Preferably, both of the first lock portion and the second lock portion are provided in the lock release operation portion, and lock release directions of the first lock portion and the second lock portion are directions different from each other.

Preferably, the first lock portion also serves as the lock release inhibiting portion.

Advantageous Effects of Invention

In accordance with the first aspect of the present invention, the lever moves from the first operation position through the connector fitting operation position to the second operation position by a rotation operation thereof. Accordingly, a required operation space is narrow by an amount that the lever is not slid, and in addition, a structure including a metal die can be simplified by an amount that a slide mechanism portion is not required. Moreover, the lever is rotated from the second operation position to the connector fitting operation position, and at the connector fitting operation position of the lever, the operation of the lock release operation portion is performed, whereby the second lock portion is displaced to the lock release position, and otherwise, the lever cannot be rotated to the first operation position. Accordingly, there can be ensured a time lag in the operation of the lever from the second operation position to the first operation position, that is, a time lag from when the signal circuit switch is switched off to when the main circuit switch is switched off. Therefore, there does not occur a malfunction such as sparks resulting from an amount of electricity remaining in the power supply circuit after the signal circuit switch is switched off.

BRIEF DESCRIPTION OF DRAWINGS

FIG. 16 (*a*) is a side view of a lock structure; and a FIG. 16(*b*) is a front view of the lock structure.

DESCRIPTION OF EMBODIMENTS

Figure 1:
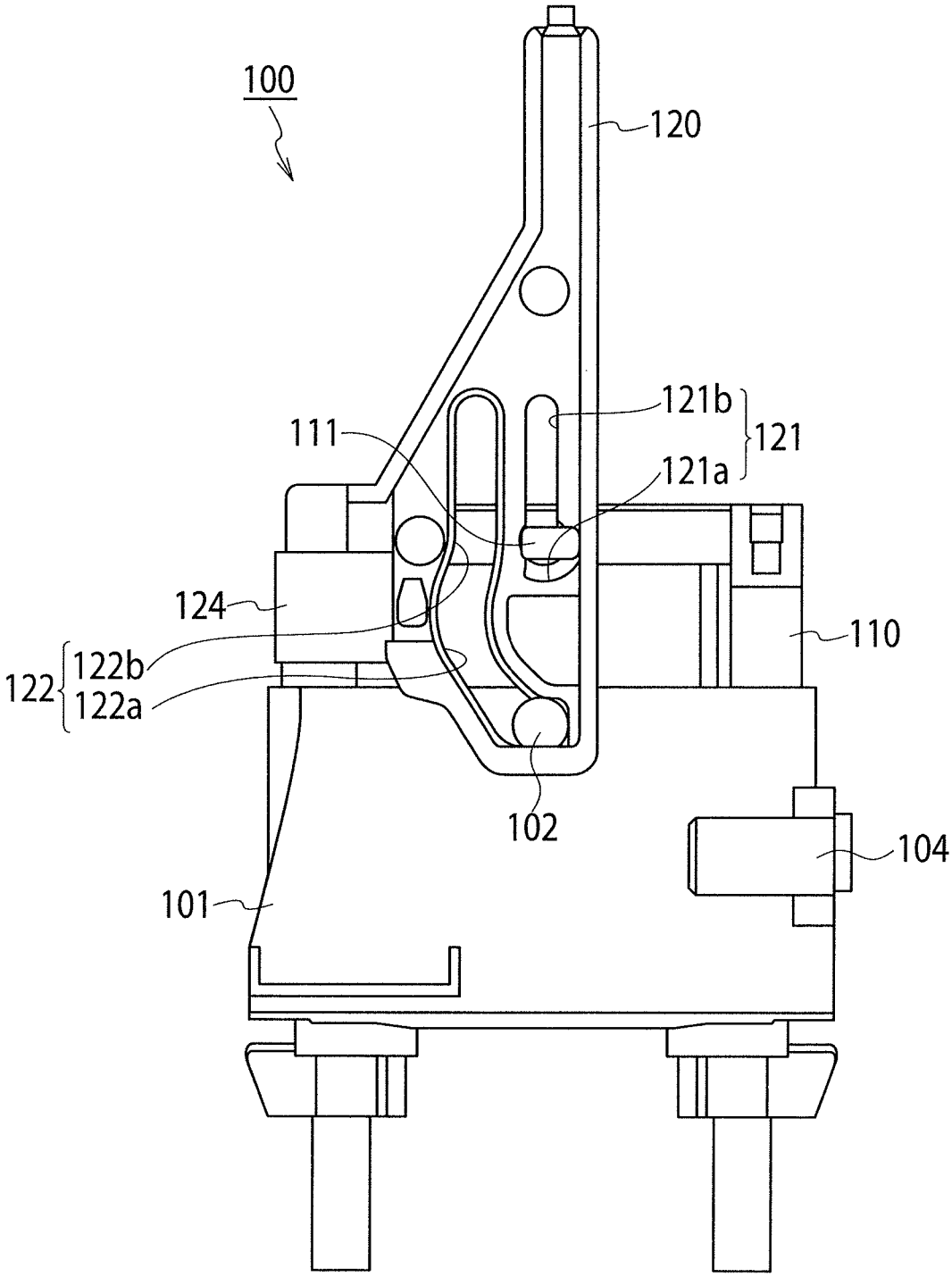
FIG. 1 shows a conventional example, and is a side view of a power supply circuit disconnection device in which a lever is located at a first operation position.
Figure 2:
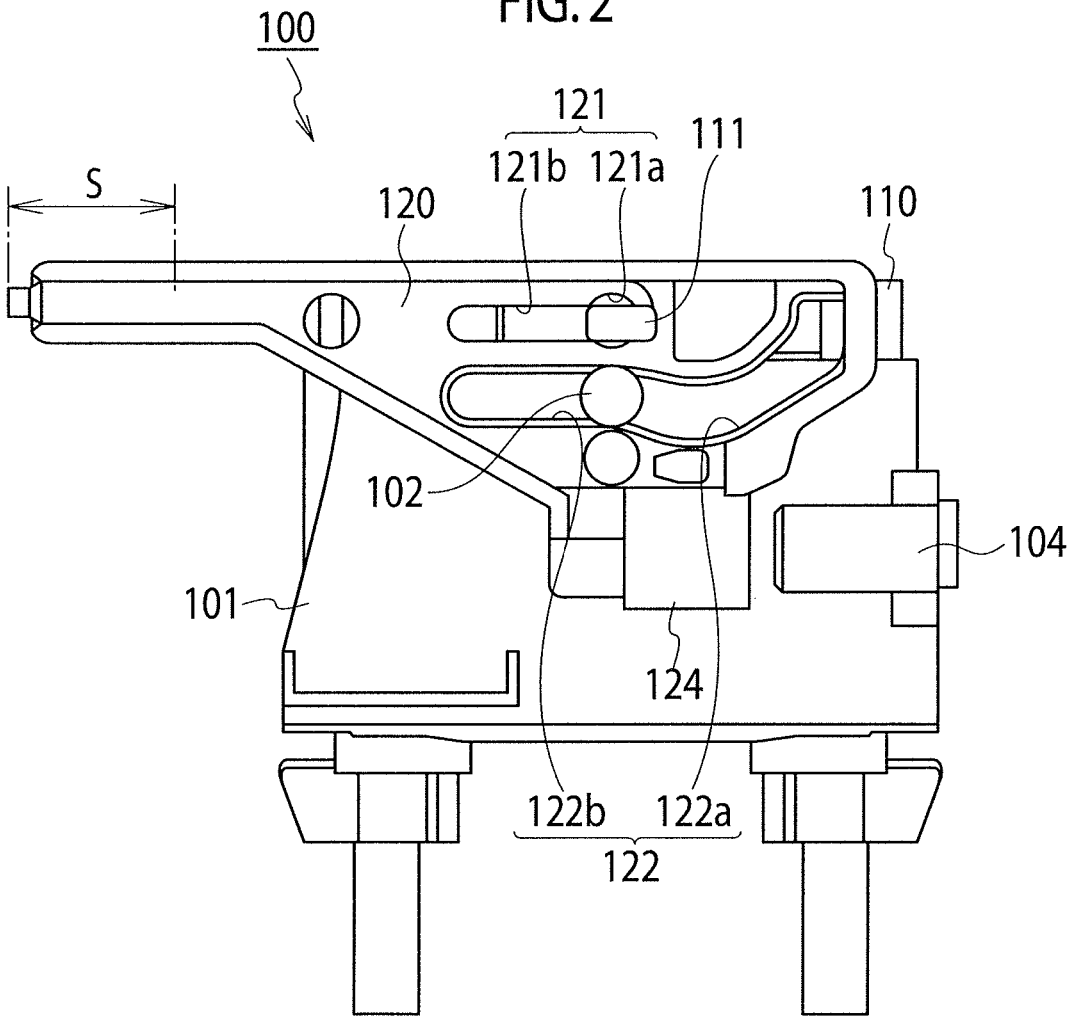
FIG. 2 shows the conventional example, and is a side view of the power supply circuit disconnection device in which the lever is located at a connector fitting operation position.
Figure 3:
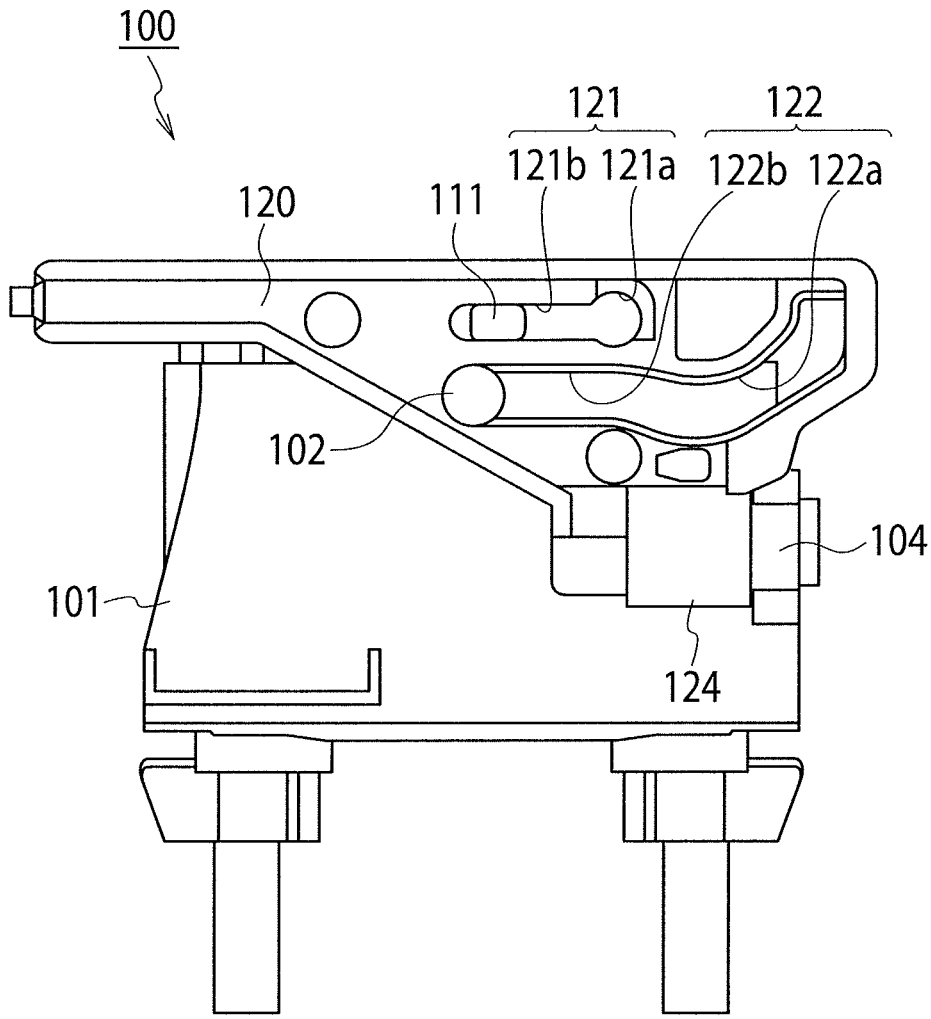
FIG. 3 shows the conventional example, and is a side view of the power supply circuit disconnection device in which the lever is located at a second operation position.

A description is made below of a first embodiment of the present invention based on the drawings.

(First Embodiment)

FIG. 4 to FIG. 11 show the first embodiment of the present invention. As shown in FIG. 4 to FIG. 11, a power supply circuit disconnection device 1A includes: a first connector housing 10; a second connector housing 20 fitted to and separated from the first connector housing 10; and a lever 30 that is rotatably provided on the second connector housing 20, and applies, by rotation thereof, fitting force and separation force between the second connector housing 20 and the first connector housing 10.

On both side surfaces of the first connector housing 10, a pair of cam pins 11 are protruded. The first connector housing 10 has a connector fitting chamber 10*a* in which an upper surface is opened. In the connector fitting chamber 10*a*, two internal terminal hood portions 12 are provided. In the respective internal terminal hood portions 12, one-side main terminals 13 are individually arranged. The respective main terminals 13 are female terminals.

In the first connector housing 10, an external terminal hood portion 15 is provided on an outside of the connector fitting chamber 10*a*. An upper portion of this external terminal hood portion 15 is opened. In the external terminal hood portion 15, two signal terminals 16 as one-side terminals are arranged. A detailed configuration of these two signal terminals 16 is described later.

On both sidewalls of the external terminal hood portion 15, first engaged portions 17 of a first lock portion LK1 are protruded. The first lock portion LK1 is composed of the first engaged portions 17 and first engaging portions 37 to be described later, and locks the lever 30 at a second operation position. The first engaged portions 17 are made easy to deflect and deform by slits 15*a* of the sidewalls of the external terminal hood portion 15.

The second connector housing 20 includes: a housing body 21 in an inside of which a fuse 2 is housed; and a cover 22 attached onto an upper surface of this housing body 21. The housing body 21 is formed to dimension/form at which the housing body 21 itself can be engaged with and separated from the connector fitting chamber 10*a* of the first connector housing 10. In a lower portion of the housing body 21, two other-side main terminals 23 are provided. The respective main terminals 23 are male terminals. The respective main terminals 23 protrude downward from the housing body 21. The two main terminals 23 are connected to each other by the fuse 2. A main circuit switch SW1 is composed of the two main terminals on the first connector housing 10 side and the two main terminals 23 on the second connector housing 20 side.

On both side surfaces of the housing body 21, a pair of rotation support shafts 24 are protruded. On both side surfaces of the housing body 21, a pair of engaging protrusions 25 are provided. The respective engaging protrusions 25 are circular protrusions with a low height.

On the housing body 21, a second engaging portion 26 of a second lock portion LK2 is protruded. The second lock portion LK2 is composed of the second engaging portion 26 and a second engaged portion 41 to be described later, and locks the lever 30 at a connector fitting operation position. The second engagement portion 26 is provided in a lock release operation portion 27. The lock release operation portion 27 is deflectable and deformable by pressing force of an operator. On a rear side of the lock release operation portion 27 and the second engaging portion 26, an elastic deformation space 28 for allowing elastic deformation thereof is formed. In such a way, when a lock release inhibiting portion 38 is not located at such a rear as a lock release position, the lock release operation portion 27 is operated to be pressed by the finger of the operator, and the like, whereby it is possible to move the second engaging portion 26 to the lock release position.

The lever 30 includes: a pair of arm plate portions 31; a coupling portion 32 that couples the pair of arm plate portions 31 to each other on a rotation tip end side; and an operation portion 33. A pair of rotation receiving portions 34 are provided in the pair of arm plate portions 31. On the pair of rotation receiving portions 34, the pair of rotation support shafts 24 of the second connector housing 20 are pivotally supported. In such a way, the lever 30 is supported on the second connector housing 20 so as to be freely rotatable. In the pair of arm plate portions 31, a pair of cam grooves 35 are formed. The cam pins 11 of the first connector housing 10 are inserted into the pair of cam grooves 35.

Figure 7:
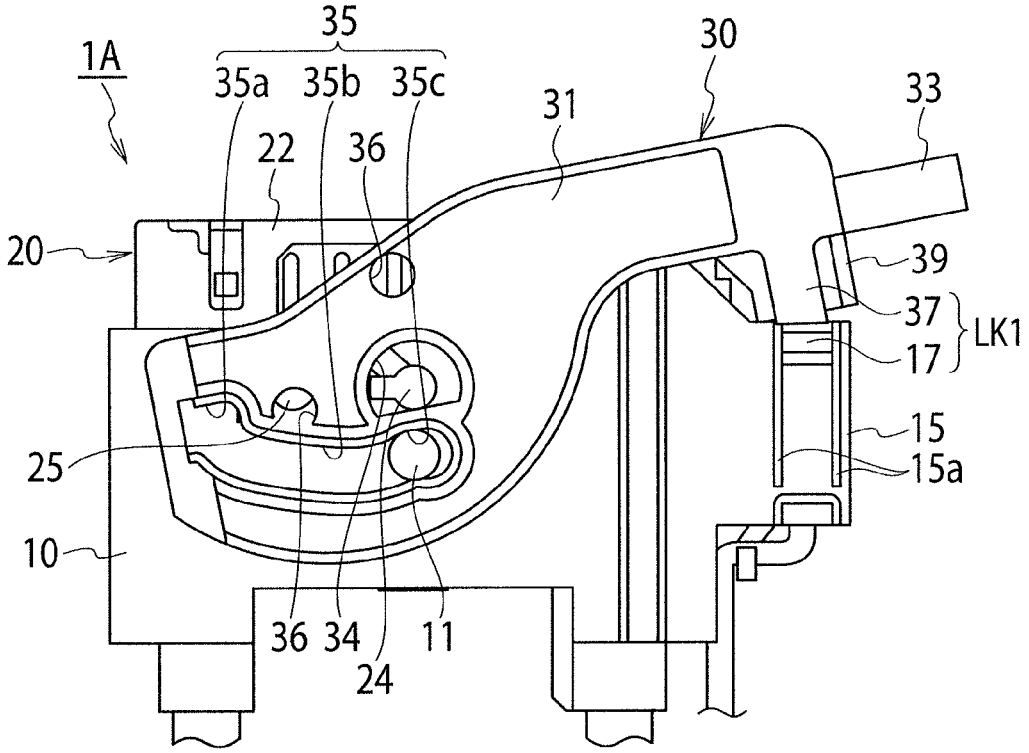
FIG. 7 shows the first embodiment of the present invention, and is a side view of the power supply circuit disconnection device in which the lever is located at a connector fitting operation position, and the first connector housing and the second connector housing are in a completely fitted state to each other.
Figure 10:
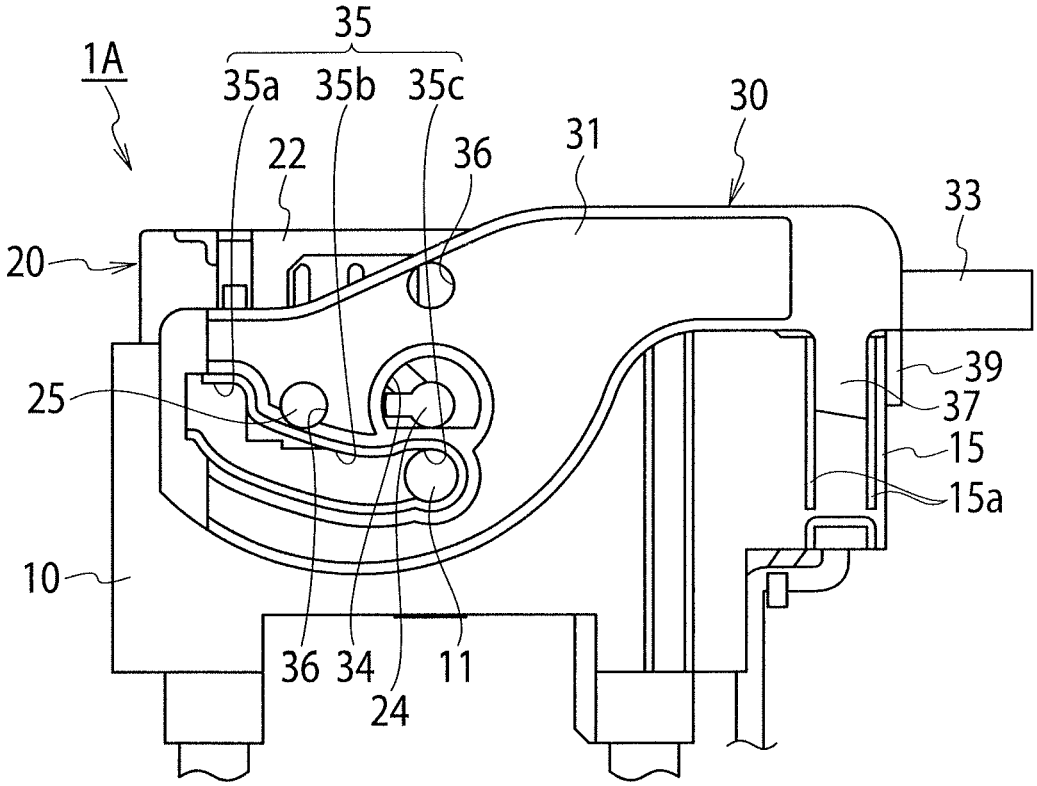
FIG. 10 shows the first embodiment of the present invention, and is a side view of the power supply circuit disconnection device in which the lever is located at the second operation position, and the first connector housing and the second connector housing are in the completely fitted state to each other.

As shown in FIG. 7 and FIG. 10, each of the cam grooves 35 has: an entrance straight portion 35*a* that allows entrance of each of the cam pins 11; a curve portion 35*b* that communicates with this entrance straight portion 35*a* and gradually changes a distance thereof from a center of each of the rotation receiving portions 34; and a circular arc portion 35*c* that communicates with the curve portion 35*b* and has a constant distance thereof from the center of the rotation receiving portion 34.

While the cam pins 11 are moving in the cam grooves 35, the lever 30 rotates between a first operation position and the second operation position that is located via the connector fitting operation position. At the first operation position, the cam pin 11 is located at the entrance straight portion 35*a*. At the connector fitting operation position, the cam pin 11 is located at a boundary position between the curve portion 35*b* and the circular arc portion 35*c*. At the second operation position, the cam pin 11 is located at a deepest position of the circular arc portion 35*c*.

That is to say, in a course where the lever 30 rotates between the first operation position and the connector fitting operation position, the cam pin 11 moves to the curve portion 35*b*, the fitting force or the separation force is applied between the first connector housing 10 and the second connector housing 20, and the first connector housing 10 and the second connector housing 20 move in a direction of being fitted to each other or a direction of being separated from each other. In a course where the lever 30 rotates between the connector fitting operation position and the second operation position, the cam pin 11 moves to the circular arc portion 35*c*, the fitting force or the separation force is not applied between the first connector housing 10 and the second connector housing 20, and the first connector housing 10 and the second connector housing 20 do not move in such a fitted direction or such a separated direction.

In each of the pair of arm plate portions 31, at two spots thereof, position holding holes 36 are provided. In the lever 30, the engaging protrusion 25 is engaged with either one of the position holding holes 36 at each of the first operation position and the second operation position. In such a way, the lever 30 is positioned at the first operation position and the second operation position by position holding force.

On the rotation tip end side of the pair of arm plate portions 31, and at lower positions thereof, the pair of first engaging portions 37 of the first lock portion LK1 are provided. The pair of first engaging portions 37 are formed to be capable of releasing the lock thereof by rotation force applied to the lever 30 by the operator. On the coupling portion 32, the plate-like lock release inhibiting portion 38 is provided.

On a lower portion of the lever operation portion 33, a hood portion 39 is provided. The hood portion 39 is opened downward. In the hood portion 39, two signal terminals 40 as other-side terminals are arranged. A detailed configuration of the two signal terminals 40 is described later. Such a signal circuit switch SW1 is composed of the two signal terminals 16 on the first connector housing 10 side and the two signal terminals 40 on the lever 30 side.

On the lever operation portion 33, the second engaged portion 41 of the second lock portion LK2 is provided.

Next, a description is briefly made of a power supply circuit system related to the power supply circuit disconnection device 1A. Between a power supply unit (not shown) and a load unit (not shown), the main circuit switch SW1 and a relay (not shown) switched on/off by the signal circuit switch SW2 are connected in series. Hence, the power supply circuit turns to an ON state in such a manner that both of the main circuit switch SW1 and the signal circuit switch SW2 turn to an ON state. In other switch states, the power supply circuit is in an OFF state.

Figure 4:
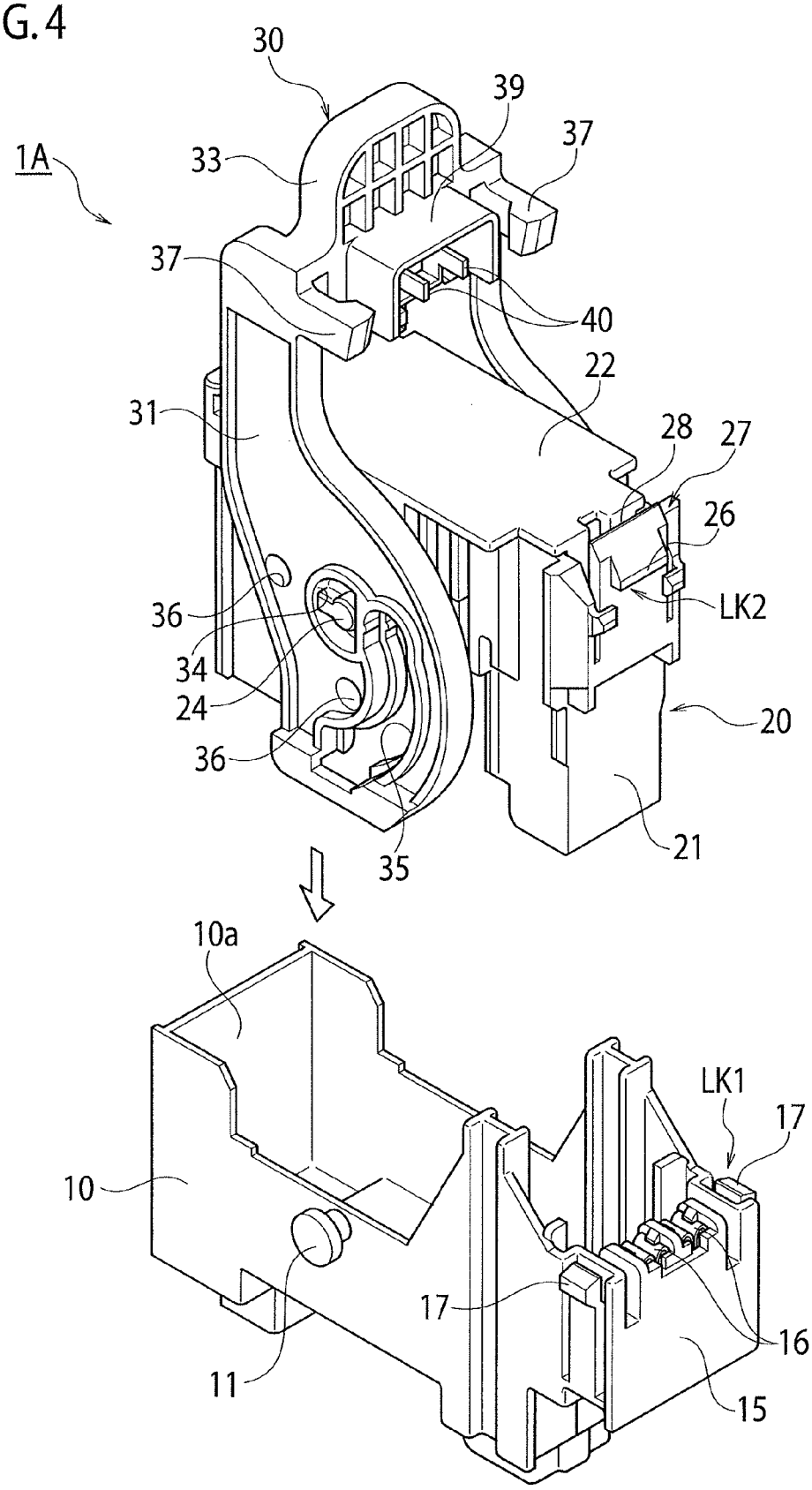
FIG. 4 shows a first embodiment of the present invention, and is a perspective view of a power supply circuit disconnection device in which a first connector housing and a second connector housing are in a separated state from each other.
Figure 5:
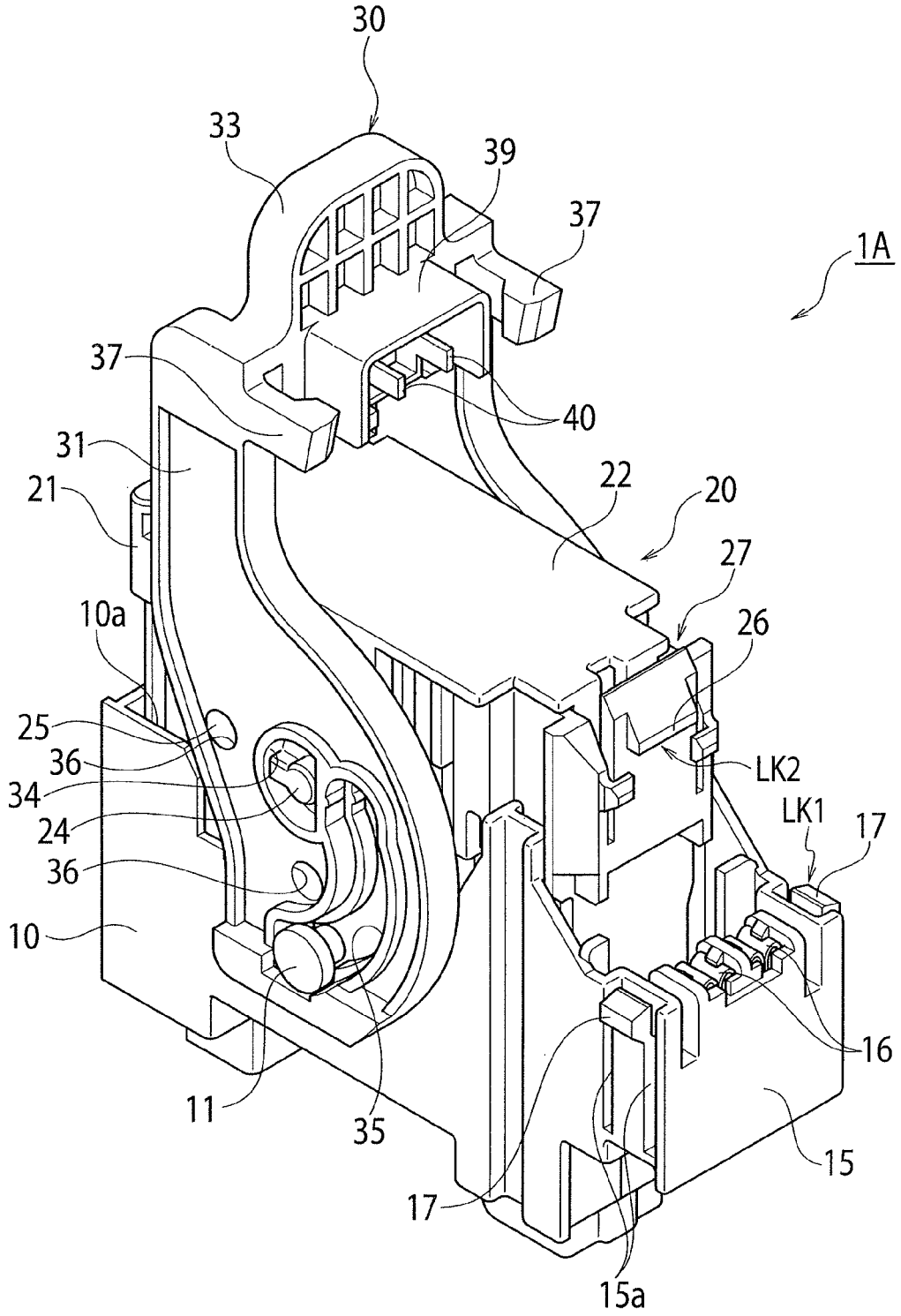
FIG. 5 shows the first embodiment of the present invention, and is a perspective view of the power supply circuit disconnection device in which a lever is located at a first operation position, and the first connector housing and the second connector housing are in a temporarily fitted state to each other.
Figure 6:
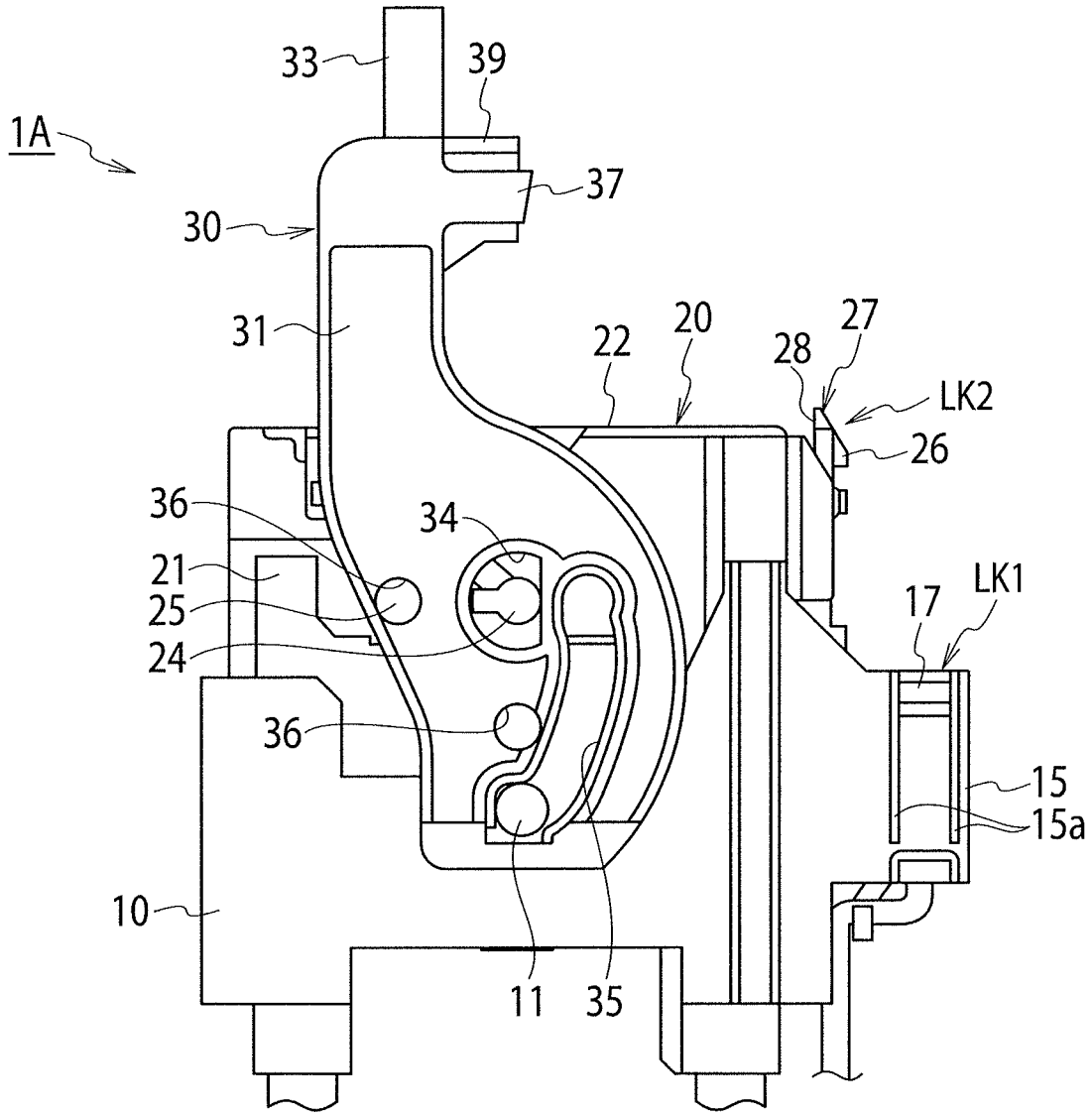
FIG. 6 shows the first embodiment of the present invention, and is a side view of the power supply circuit disconnection device in which the lever is located at the first operation position, and the first connector housing and the second connector housing are in the temporarily fitted state to each other.

A description is made of a conductive operation of the power supply circuit by the power supply circuit disconnection device 1A in the above-described configuration. As shown in FIG. 4, the second connector housing 20 in which the lever 30 is set at the first operation position is positioned to the connector fitting chamber 10*a* of the first connector housing 10. Then, as shown in FIG. 5 and FIG. 6, the second connector housing 20 is inserted into the connector fitting chamber 10*a* of the first connector housing 10, and the cam pins 11 are inserted into the entrance straight portions 35*a* of the cam grooves 35 of the lever 30. Both of the connector housings 10 and 20 turn to a temporarily fitted state of a connector.

Next, the lever 30 is rotated from the first operation position to the second operation position side. Then, the cam pins 11 move in the cam grooves 35, the fitting force is applied between the second connector housing 20 and the first connector housing 10, and the second connector housing 20 is gradually inserted into the connector fitting chamber 10*a* of the first connector housing 10.

Figure 8:
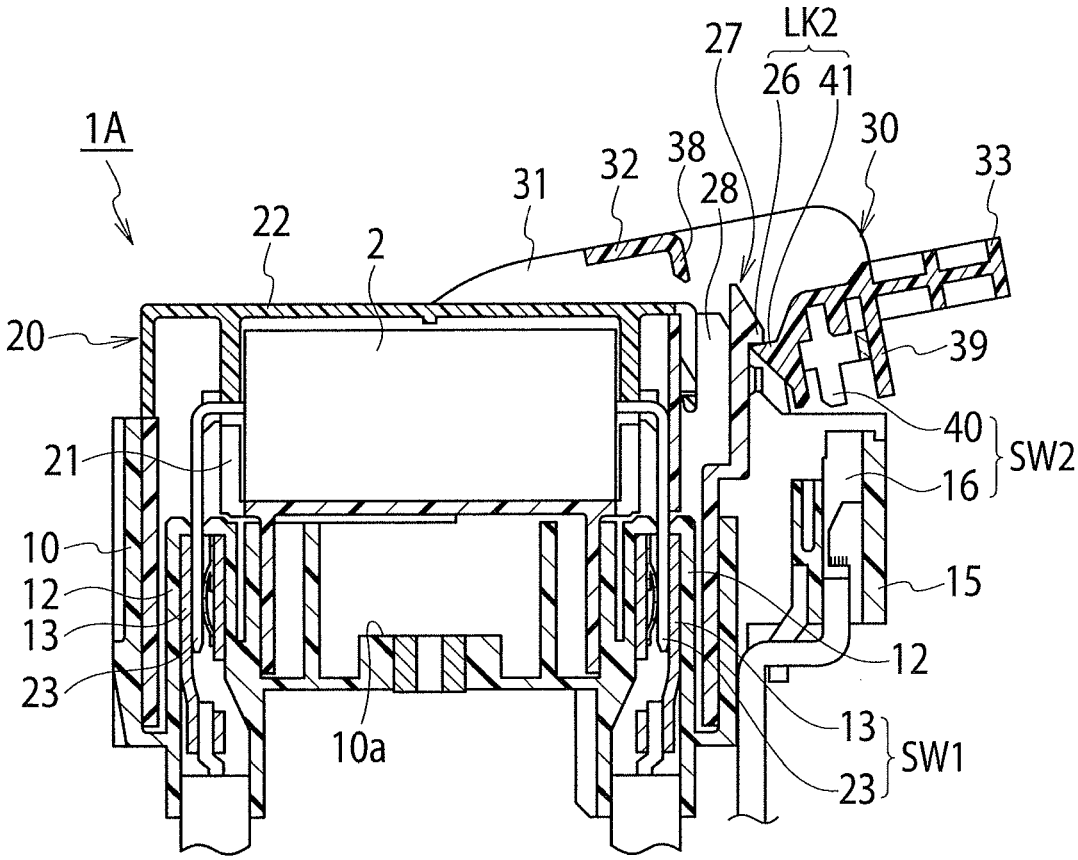
FIG. 8 shows the first embodiment of the present invention, and is a cross-sectional view of the power supply circuit disconnection device in which the lever is located at the connector fitting operation position, and the first connector housing and the second connector housing are in the completely fitted state to each other.

When the lever 30 is rotated to the connector fitting operation position, as shown in FIG. 7 and FIG. 8, the second engaged portion 41 gets over the second engaging portion 26, the second lock portion LK2 turns to a lock position, and the first connector housing 10 and the second connector housing 20 turn to a completely fitted state to each other. In the course from the first operation position to the connector fitting operation position, both of the main terminals 13 and 23 start to contact each other, and such contact is completed at the connector fitting operation position. At the connector fitting operation position of the lever 30, the main circuit switch SW1 turns to the ON state.

Figure 9:
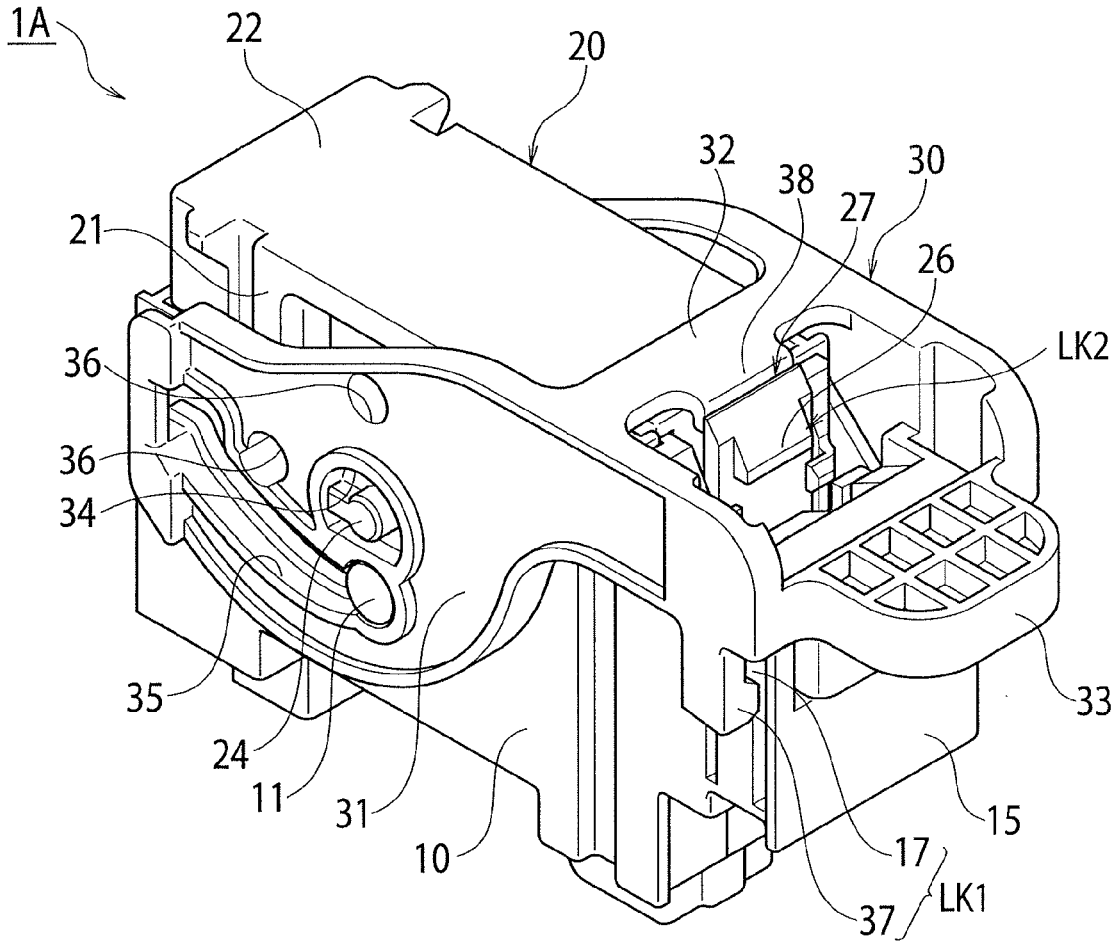
FIG. 9 shows the first embodiment of the present invention, and is a perspective view of the power supply circuit disconnection device in which the lever is located at a second operation position, and the first connector housing and the second connector housing are in the completely fitted state to each other.
Figure 11:
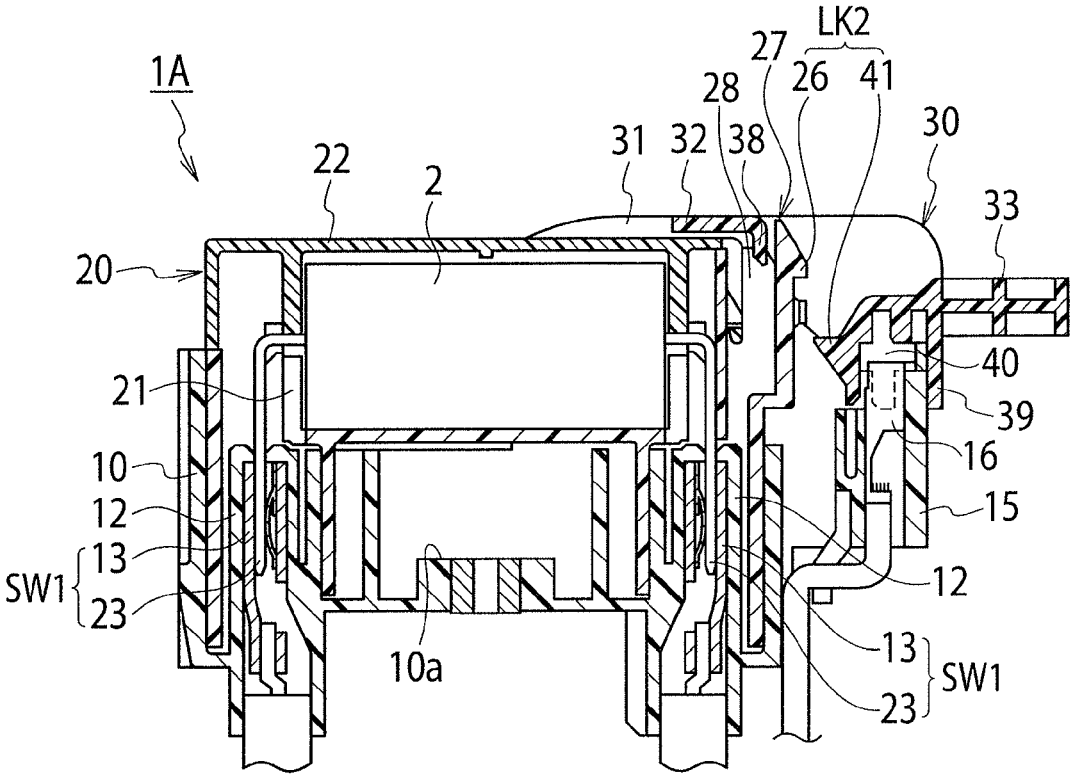
FIG. 11 shows the first embodiment of the present invention, and is a cross-sectional view of the power supply circuit disconnection device in which the lever is located at the second operation position, and the first connector housing and the second connector housing are in the completely fitted state to each other.

When the lever 30 is rotated from the connector fitting operation position to the second operation position, as shown in FIG. 9 to FIG. 11, the lock release inhibiting portion 38 enters the elastic deformation space 28, and in addition, the first engaging portions 37 get over the first engaged portions 17, and the first lock portion LK1 turns to a lock position. In a course where the lever 30 rotates from the connector fitting operation position to the second operation position, both of the signal terminals 16 and 40 start to contact each other, and such contact is completed at the second operation position. At the second operation position of the lever 30, the signal circuit switch SW2 turns to the ON state. That is to say, the power supply circuit is non-conductive at the connector fitting operation position of the lever 30, and does not turn to a conductive state until the lever 30 turns to the second operation position.

Next, a description is made of a power supply disconnection operation by the power supply circuit disconnection device 1A. As shown in FIG. 9 to FIG. 11, in a state where the lever 30 is located at the second operation position, the lever 30 is rotated by rotation force stronger than locking force between the first engaging portions 37 and the first engaged portions 17. Then, the lock between the first engaging portions 37 and the first engaged portions 17 is released, and the rotation of the lever 30 is allowed. In such a way, as shown in FIG. 7 and FIG. 8, the lever 30 is rotated to a completely fitting operation position of the connector. When the lever 30 is rotated to such a connector completely fitting operation position, the second engaged portion 41 of the lever 30 is engaged with the second engaging portion 26, and the second lock portion LK2 turns to the lock state. In such a way, the rotation of the lever 30 is inhibited once. In a course where the lever 30 rotates from the second operation position to the connector fitting operation position, both of the signal terminals 16 and 40 gradually come not to contact each other, and at the connector fitting operation position of the lever 30, both of the signal terminals 16 and 40 come into non-contact with each other completely. Hence, at the connector completely fitting operation position of the lever 30, the signal circuit switch SW2 turns to the OFF state. The power supply circuit becomes non-conductive at the connector fitting operation position of the lever 30.

Moreover, by the rotation of the lever 30 from the second operation position to the connector fitting operation position, the lock release inhibiting portion 38 of the lever 30 coms off from the elastic deformation space 28 of the first connector housing 10.

Next, the lock release operation portion 27 is elastically deformed by using the elastic deformation space 28, the second engaging portion 26 of the second lock portion LK2 is displaced to the lock release position, and the lock thereof with the second engaged portion 41 is released. In such a way, rotation of the lever 30 to the first operation position side is allowed, and the lever 30 is rotated to the first operation position. In the rotation of the lever 30 from the connector fitting position to the first operation position, the separation force is applied between the second connector housing 20 and the first connector housing 10 by the cam grooves 35 and the cam pins 11, and the second connector housing 20 is gradually pulled out from the connector chamber 10*a* of the first connector housing 10.

As shown in FIG. 5 and FIG. 6, at the first operation position of the lever 30, the first connector housing 10 and the second connector housing 20 turn to the temporarily fitted state to each other. The main terminals 13 and 23 of both of the first connector housing 10 and the second connector housing 20 gradually come not to contact each other in the course from the connector fitting operation position to the first operation position, and turn to a non-contact state with each other completely at the first operation position. Hence, at the first operation position of the lever 30, the main circuit switch SW1 turns to the OFF state.

As described above, the power supply circuit disconnection device 1A includes: the first connector housing 10; the second connector housing 20; the lever 30 rotatably provided on the second connector housing 20; the main circuit switch SW1 that has the main terminals 13 and 23 provided in the first connector housing 10 and the second connector housing 20, respectively, is turned to the OFF state at the first operation position of the lever 30, and is turned to the ON state at the connector fitting operation position and second operation position of the lever 30; the signal circuit switch SW2 that has the signal terminals 16 and 40 provided in the first connector housing 10 and the lever 30, respectively, is turned to the OFF state at the first operation position and connector fitting operation position of the lever 30, and is turned to the ON state at the second operation position of the lever 30; the first lock portion LK1 that locks the lever 30 at the second operation position; the second lock portion LK2 that locks the lever 30 at the connector fitting operation position; and the lock release operation portion 27 capable of releasing the lock state of the second lock portion LK2 by the operation.

Hence, by the rotation operation, the lever 30 moves from the first operation position through the connector fitting operation position to the second operation position. Accordingly, the required operation space is narrow by an amount that the lever 30 is not slid, and in addition, the structure including the metal die can be simplified by an amount that a slide mechanism portion is not required. Moreover, the lever 30 is rotated from the second operation position to the connector fitting operation position, and at the connector fitting operation position of the lever 30, the operation of the lock release operation portion 27 is performed, whereby the second lock portion LK2 is displaced to the lock release position, and otherwise, the lever 30 cannot be rotated to the first operation position. Accordingly, there can be ensured a time lag in the operation of the lever 30 from the second operation position to the first operation position, that is, a time lag from when the signal circuit switch SW2 is switched off to when the main circuit switch SW1 is switched off. Therefore, there does not occur a malfunction such as sparks resulting from an amount of electricity remaining in the power supply circuit after the signal circuit switch SW2 is switched off.

The power supply circuit disconnection device 1A has the lock release inhibiting portion 38 that inhibits the movement of the second lock portion LK2 to the lock release position at the second operation position of the lever 30, and allows the movement of the second lock portion LK2 to the lock release position at the connector fitting operation position of the lever 30. Hence, the second engaging portion 26 cannot be moved to the lock release position until the lever 30 is rotated from the second operation position to the connector fitting operation position. Accordingly, at the connector fitting operation position of the lever 30, an operation to move the second engaging portion 26 of the second lock portion LK2 to the lock release position is inserted, and there can be surely ensured the time lag in the operation of the lever 30 from the second operation position to the first operation position, that is, the time lag from when the signal circuit switch SW2 is switched off to when the main circuit switch SW1 is switched off. Therefore, there can be surely avoided the occurrence of the malfunction such as the sparks resulting from the amount of electricity remaining in the power supply circuit after the signal circuit switch SW2 is switched off.

The lever 30 is configured to apply the fitting force and the separation force between the second connector housing 20 and the first connector housing 10 by the rotation thereof between the first operation position and the connector fitting operation position, and not to apply the fitting force and the separation force between the second connector housing 20 and the first connector housing 10 by the rotation thereof between the connector fitting operation position and the second operation position. Hence, the cam grooves 35 are set so that, in the course where the lever 30 rotates from the second operation position to the connector fitting operation position, the pairs of main terminals 13 and 23 cannot move at all, and the signal switch SW2 can be switched off. The pairs of main terminals 13 and 23 of the main circuit switch SW1 move for the first time in the course where the lever 30 rotates from the connector fitting operation position to the first operation position after the power supply circuit turns to the OFF state. Hence, such a malfunction can be prevented, which results from that the main terminals 13 and 23 of the main circuit switch SW1 move when both of the main circuit switch SW1 and the signal circuit switch SW2 are switched on, that is, the power supply circuit is conducting.

It is possible to release the lock of the first lock portion LK1 by the rotation force applied to the lever 30 by the operator, and it is possible to release the lock of the second lock portion LK2 by the pressing force of the operator. Hence, the operator can perform the operation from the first operation position of the lever 30 to the second operation position thereof without using a tool, a jig or the like.

(Second Embodiment)

Figure 12:
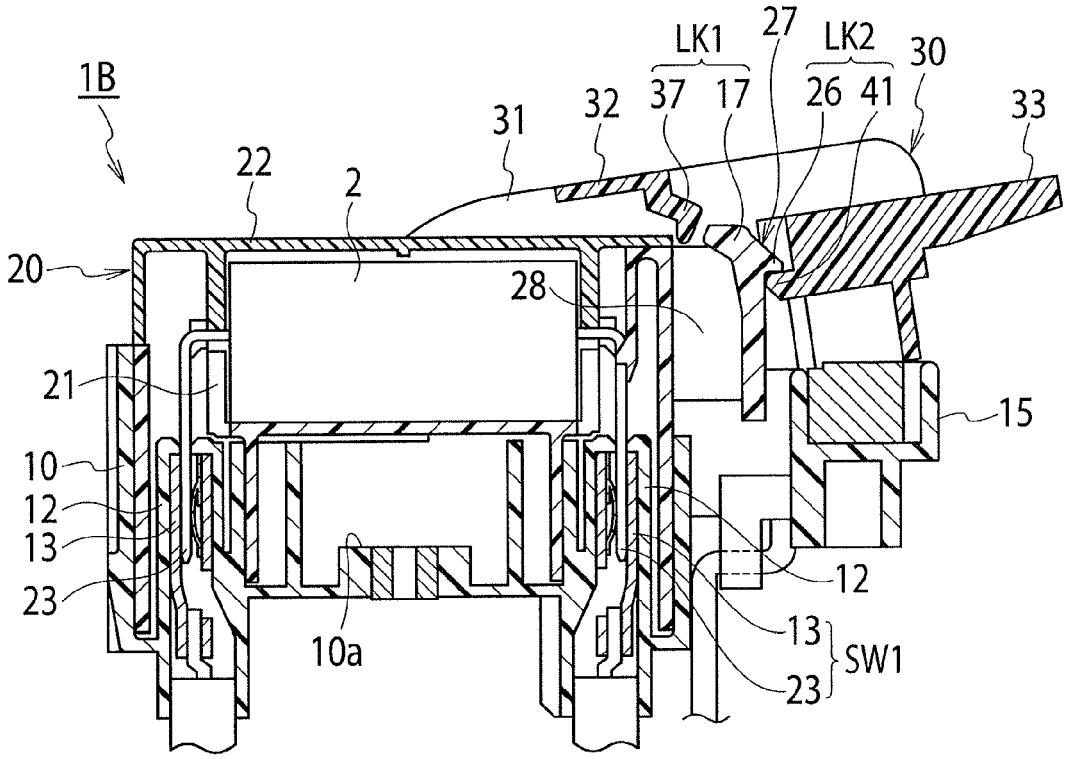
FIG. 12 shows a second embodiment of the present invention, and is a cross-sectional view of a power supply circuit disconnection device in which a lever is located at a connector fitting operation position, and a first connector housing and a second connector housing are in a completed fitted state to each other.
Figure 13:
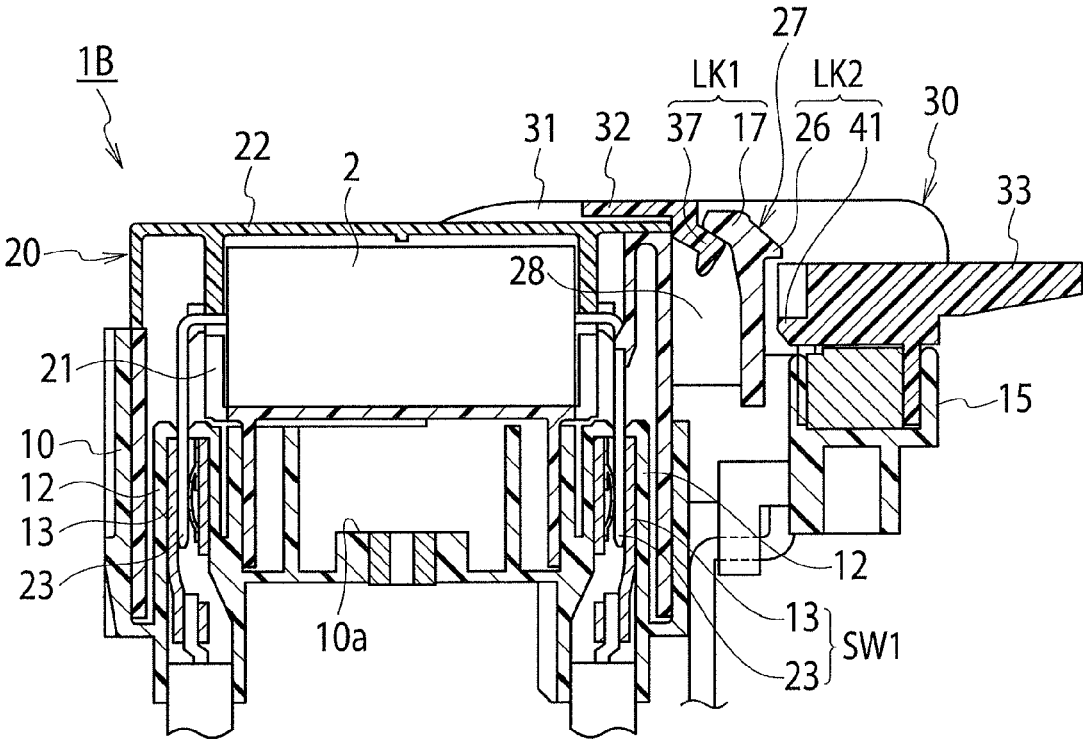
FIG. 13 shows the second embodiment of the present invention, and is a cross-sectional view of the power supply circuit disconnection device in which the lever is located at a second operation position, and the first connector housing and the second connector housing are in the completed fitted state to each other.

FIG. 12 and FIG. 13 show a second embodiment of the present invention. A power supply circuit disconnection device 1B of this second embodiment is different from the power supply circuit disconnection device 1A of the first embodiment only in configurations of the first lock portion LK1 and the second lock portion LK2.

That is to say, as shown in FIG. 12 and FIG. 13, both of a first engaged portion 17 of the first lock portion LK1 and a second engaging portion 26 of the second lock portion LK2 are provided in the lock release operation portion 27 of the second connector housing 20. The lock release operation portion 27 is deflectable and deformable by the pressing force of the operator. On the rear side of the lock release operation portion 27 and the second engaging portion 26, the elastic deformation space 28 for allowing elastic deformation thereof is formed. In such a way, when the lock release inhibiting portion 38 is not located at such a rear as the lock release position, the lock release operation portion 27 is operated to be pressed by the finger of the operator, and the like, whereby it is possible to move the second engaging portion 26 to the lock release position.

In addition, the first engaging portion 37 of the first lock portion LK1 and the second engaged portion 41 of the second lock portion LK2 enter engagement positions thereof from directions reverse to each other in the lock release operation portion 27. Then, the first engaging portion 37 of the first lock portion LK1 engages with the first engaged portion 17 at a position of entering the elastic deformation space 28. That is to say, the first engaging portion 37 of the first lock portion LK1 also serves as the lock release inhibiting portion of the first embodiment. At a second operation position (a position in FIG. 13) of the lever 30, the movement of the second engaging portion 26 of the second lock portion LK2 to the lock release position is inhibited, and at a connector fitting operation position (a position in FIG. 12) of the lever 30, the movement of the second engaging portion 26 of the second lock portion LK2 to the lock release position is allowed.

Other configurations are similar to those of the above-described first embodiment, and accordingly, a duplicate description is omitted. The same reference numerals are assigned to the same constituent spots between FIG. 12 and FIG. 13, and clarification thereof is achieved.

Also in this second embodiment, similar effects to those of the above-described first embodiment are obtained. That is to say, there does not occur the malfunction such as the sparks resulting from the amount of electricity remaining in the power supply circuit after the signal circuit switch SW2 is switched off. The malfunction can be prevented, which results from that the main terminals 13 and 23 of the main circuit switch SW1 move when the power supply circuit is conducting. The operator can perform the operation from the first operation position of the lever 30 to the second operation position thereof without using the tool, the jig or the like.

The first lock portion LK1 also serves as the lock release inhibiting portion, and accordingly, the simplification of the structure can be achieved.

(Third Embodiment)

Figure 14:
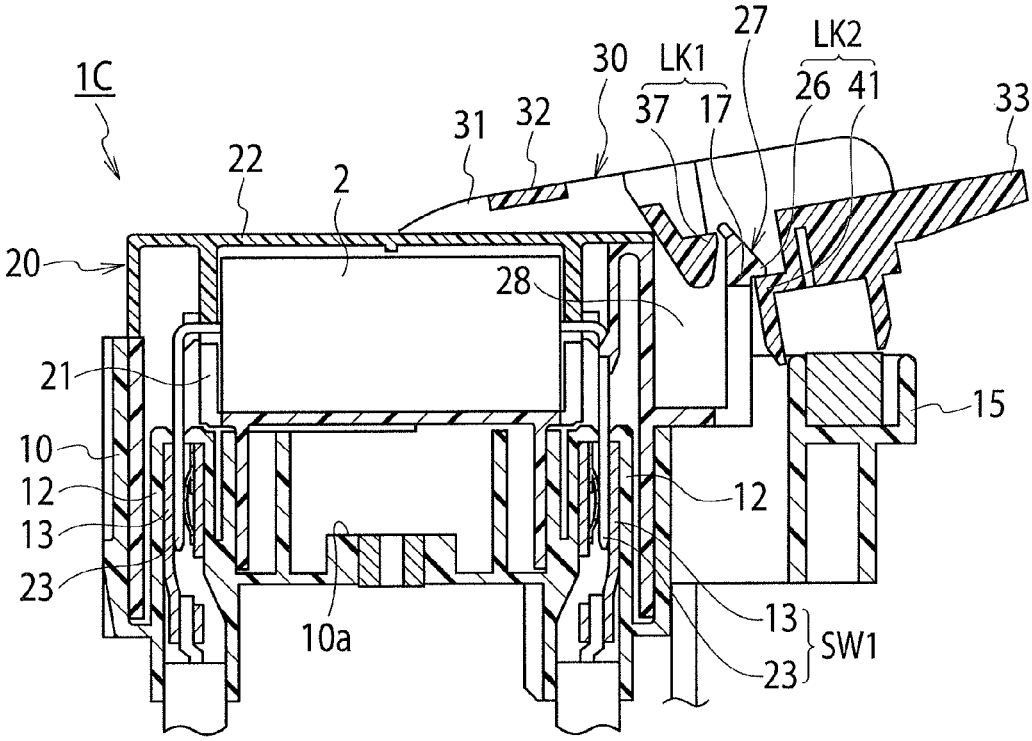
FIG. 14 shows a third embodiment of the present invention, and is a cross-sectional view of the power supply circuit disconnection device in which the lever is located at a connector fitting operation position, and a first connector housing and a second connector housing are in a completely fitted state to each other.
Figure 15:
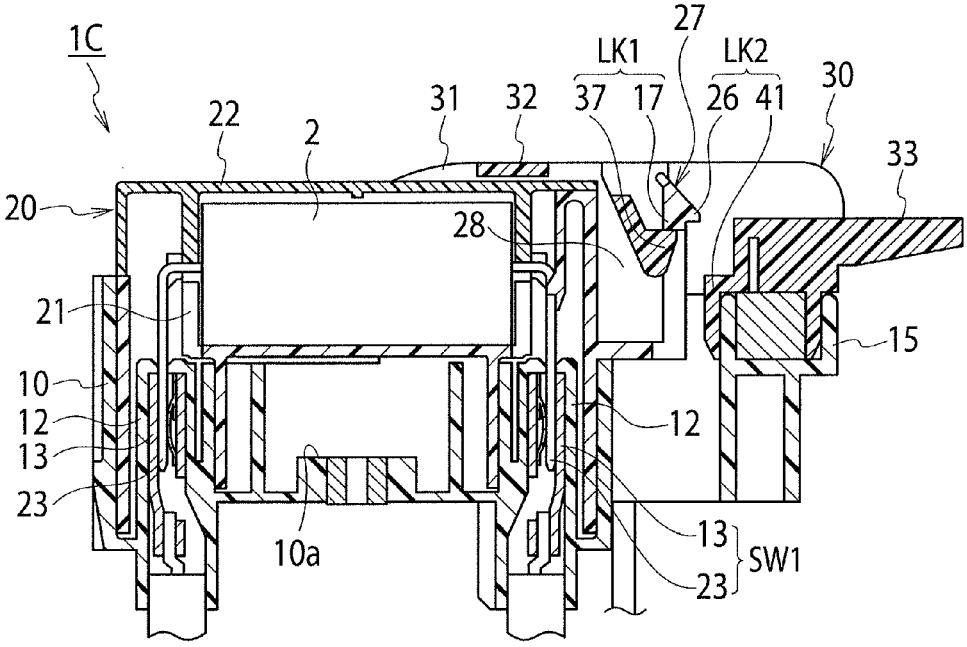
FIG. 15 shows the third embodiment of the present invention, and is a cross-sectional view of the power supply circuit disconnection device in which the lever is located at a second operation position, and the first connector housing and the second connector housing are in the completely fitted state to each other.
Figure 16:
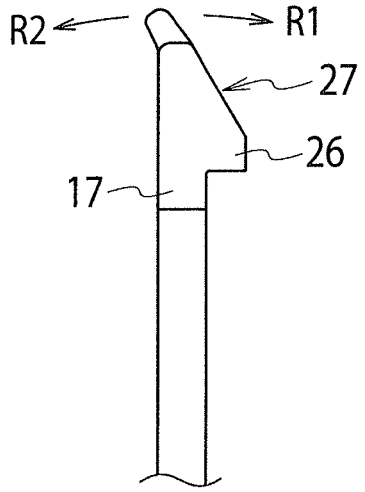
FIGS. 16(*a*) and 16(*b*) show the third embodiment of the present invention.
Figure 16:
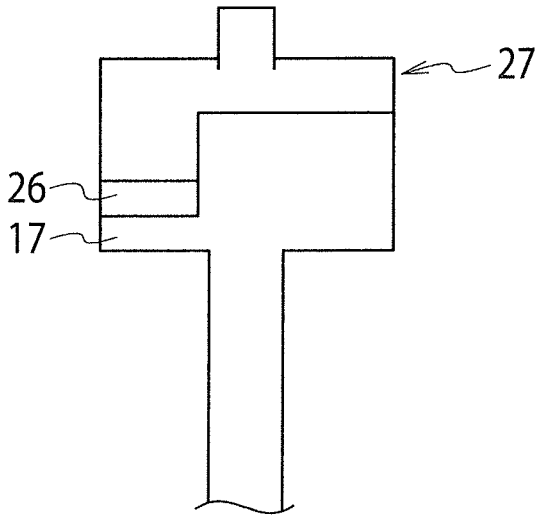

FIG. 14 to FIG. 16 show a third embodiment of the present invention. A power supply circuit disconnection device 1C of this third embodiment is different from the power supply circuit disconnection device 1A of the first embodiment only in configurations of the first lock portion LK1 and the second lock portion LK2.

That is to say, as shown in FIG. 14, FIG. 15 and FIG. 16, in a similar way to the second embodiment, both of a first engaged portion 17 of the first lock portion LK1 and a second engaging portion 26 of the second lock portion LK2 are provided in the lock release operation portion 27 of the second connector housing 20. The lock release operation portion 27 is deflectable and deformable by the pressing force of the operator individually in a direction R1 in FIG. 16 and a direction R2 as a reverse direction thereto. On the rear side of the lock release operation portion 27 and the second engaging portion 26, the elastic deformation space 28 for allowing elastic deformation of the lock release operation portion 27 and the second engaging portion 26 is formed. In such a way, when the lock release inhibiting portion 38 is not located at such a rear as the lock release position, the lock release operation portion 27 is operated to be pressed by the finger of the operator, and the like, whereby it is possible to move the second engaging portion 26 to the lock release position.

In addition, in a similar way to the above-described second embodiment, the first engaging portion 37 of the first lock portion LK1 and the second engaged portion 41 of the second lock portion LK2 enter engagement positions thereof from directions reverse to each other in the lock release operation portion 27. Then, the first engaging portion 37 of the first lock portion LK1 engages with the first engaged portion 17 at a position of entering the elastic deformation space 28. That is to say, the first engaging portion 37 of the first lock portion LK1 also serves as the lock release inhibiting portion of the first embodiment. At a second operation position (a position in FIG. 15) of the lever 30, the movement of the second engaging portion 26 of the second lock portion LK2 to the lock release position is inhibited, and at a connector fitting operation position (a position in FIG. 14) of the lever 30, the movement of the second engaging portion 26 of the second lock portion LK2 to the lock release position is allowed.

Moreover, unlike in the above-described first and second embodiments, the first engaging portion 37 and first engaged portion 17 of the first lock portion LK1 are configured so that the lock therebetween cannot be released by the rotation force applied to the lever 30 by the operator, but that the lock can be released by deflecting the lock release operation portion 27 by the pressing force by the finger of the operator, and the like. That is to say, in the third embodiment, both of the first lock portion LK1 and the second lock portion LK2 are configured so as to be capable of releasing the lock thereof by the pressing force of the operator.

Furthermore, lock release directions of the first lock portion LK1 and the second lock portion LK2 are different directions. Specifically, the lock of the first lock portion LK1 can be released by deflecting the lock release operation portion 27 in the arrow direction R1, and the lock of the second lock portion LK2 can be released by deflecting the lock release operation portion 27 in the arrow direction R2.

Other configurations are similar to those of the above-described first embodiment, and accordingly, a duplicate description is omitted. The same reference numerals are assigned to the same constituent spots between FIG. 14 and FIG. 15, and clarification thereof is achieved.

Also in this third embodiment, similar effects to those of the above-described first embodiment are obtained. That is to say, there does not occur the malfunction such as the sparks resulting from the amount of electricity remaining in the power supply circuit after the signal circuit switch SW2 is switched off. The malfunction can be prevented, which results from that the main terminals 13 and 23 of the main circuit switch SW1 move when the power supply circuit is conducting. The operator can perform the operation from the first operation position of the lever 30 to the second operation position thereof without using the tool, the jig or the like.

The first lock portion LK1 also serves as the lock release inhibiting portion, and accordingly, the simplification of the structure can be achieved.

Both of the first lock portion LK1 and the second lock portion LK2 are configured so as to be capable of releasing the lock thereof by the pressing force of the operator. Hence, both of the lock release of the first lock portion LK1 and the lock release of the second lock portion LK2 can be performed only by definite lock release operations of the operator, and accordingly, safety is further enhanced.

Both of the first lock portion LK1 and the second lock portion LK2 are provided on the lock release operation portion 27, and the lock release directions of the first lock portion LK1 and the second lock portion LK2 are different directions. Accordingly, both of the lock release of the first lock portion LK1 and the lock release of the second lock portion LK2 can be performed only by further definite lock release operations of the operator, and accordingly, the safety is further enhanced.

INDUSTRIAL APPLICABILITY

In accordance with the present invention, by the rotation operation, the lever moves from the first operation position through the connector fitting operation position to the second operation position. Accordingly, the required operation space is narrow by the amount that the lever is not slid, and in addition, the structure including the metal die can be simplified by the amount that the slide mechanism portion is not required. Moreover, the lever is rotated from the second operation position to the connector fitting operation position, and at the connector fitting operation position of the lever, the operation of the lock release operation portion is performed, whereby the second lock portion is displaced to the lock release position, and otherwise, the lever cannot be rotated to the first operation position. Accordingly, there can be ensured the time lag in the operation of the lever from the second operation position to the first operation position, that is, the time lag from when the signal circuit switch is switched off to when the main circuit switch is switched off. Therefore, there does not occur the malfunction such as the sparks resulting from the amount of remaining electricity after the signal circuit switch is switched off.

The invention claimed is:

1. A power supply circuit disconnection device comprising:

a first connector housing;

a second connector housing fitted to and separated from the first connector housing;

a lever that is rotatably provided on the second connector housing, applies fitting force and separation force between the second connector housing and the first connector housing by rotation of the lever between a first operation position and a connector fitting operation position, and rotates from the connector fitting operation position to a second operation position;

a main circuit switch that has main terminals provided individually on the first connector housing and the second connector housing, is turned to an OFF state at the first operation position of the lever, and is turned to an ON state at the connector fitting operation position and second operation position of the lever;

a signal circuit switch that has signal terminals provided individually on the first connector housing and the lever, is turned to an OFF state at the first operation position and connector fitting operation position of the lever, and is turned to an ON state at the second operation position of the lever;

a first lock portion that locks the lever at the second operation position;

a second lock portion that locks the lever at the connector fitting operation position; and a lock release operation portion capable of releasing, by an operation of the lock release operation portion, a lock state of the second lock portion.

2. The power supply circuit disconnection device according to claim 1, further comprising:

a lock release inhibiting portion that inhibits movement of the second lock portion to a lock release position at the second operation position of the lever, and allows the second lock portion to move to the lock release position at the connector fitting operation position of the lever.

3. The power supply circuit disconnection device according to either one of claims 1 and 2, wherein the lever is configured to apply the fitting force and the separation force between the second connector housing and the first connector housing by the rotation of the lever between the first operation position and the connector fitting operation position, and not to apply the fitting force and the separation force between the second connector housing and the first connector housing by rotation of the lever between the connector fitting operation position and the second operation position.

4. The power supply circuit disconnection device according to either one of claims 1 and 2, wherein the first lock portion is capable of releasing lock of the first lock portion by rotation force applied to the lever by an operator, and the second lock portion is capable of releasing lock of the second lock portion by pressing force of the operator.

5. The power supply circuit disconnection device according to either one of claims 1 and 2, wherein both of the first lock portion and the second lock portion are capable of releasing lock of the first and second lock portions by pressing force of an operator.

6. The power supply circuit disconnection device according to claim 5, wherein both of the first lock portion and the second lock portion are provided in the lock release operation portion, and lock release directions of the first lock portion and the second lock portion are different from each other.

7. The power supply circuit disconnection device according to either one of claims 1 and 2, wherein the first lock portion also serves as the lock release inhibiting portion.

* * * * *